US005714960A

United States Patent [19]

Choi

[11] Patent Number: 5,714,960

[45] Date of Patent: Feb. 3, 1998

[54] PARABOLIC ANTENNA

[75] Inventor: Yong-Hwan Choi, Seoul, Rep. of Korea

[73] Assignee: Daewoo Electronics Co., Ltd., Seoul, Rep. of Korea

[21] Appl. No.: 684,754

[22] Filed: Jul. 19, 1996

[30] Foreign Application Priority Data

Jul. 21, 1995 [KR] Rep. of Korea ..... 95-21504
Jul. 21, 1995 [KR] Rep. of Korea ..... 95-21505

[51] Int. Cl.[6] ..... H01Q 3/16

[52] U.S. Cl. ..... 343/761; 343/839; 343/840

[58] Field of Search ..... 343/839, 840, 343/915, 882, 761; H01Q 1/12, 3/16

[56] References Cited

U.S. PATENT DOCUMENTS 3,076,964 2/1963 Reinhold ..... 343/915
3,747,113 7/1973 De Vellis ..... 343/872
4,862,190 8/1989 Palmer et al. ..... 343/915
4,998,114 3/1991 Eto et al. ..... 343/916

*Primary Examiner*—Michael C. Wimer
*Attorney, Agent, or Firm*—Pennie and Edmonds, LLP

[57] ABSTRACT

A parabolic antenna includes a reflector, a feed horn positioned at a focal point of the reflector, a frame fixed on a rear side of the reflector at one end, an arm on one end of which the feed horn is fixed, a pair of hinges, a boss and a shaft. The hinges extend from the other end of the arm and spaced apart from each other, and the boss extends from the other end of the frame and is interposed between the hinges. The shaft is fitted through one hinge and into the boss and the other hinge. The parabolic antenna is further provided with at least one ball stopper having a ball and a spring. The ball stopper is inserted in a blind hole formed on an inner surface of each hinge, and the spring presses the ball against the boss so that the ball is fitted into one of the recesses, thereby holding the arm and the frame at a desired angle.

9 Claims, 10 Drawing Sheets

PARABOLIC ANTENNA

FIELD OF THE INVENTION

The present invention relates to a parabolic antenna; and, more particularly, to a parabolic antenna capable of allowing a feed horn to be placed at a focal point of a reflector with ease.

DESCRIPTION OF THE PRIOR ART

There is shown in FIG. 1 a schematic view of a conventional parabolic antenna disclosed in U.S. Pat. No. 4,819,007. The conventional parabolic antenna includes a reflector 3, a feed horn 4, a frame 5 and an arm 6.

The reflector 3 concentrates, e.g., radio waves from an earth satellite 2 at a focal point thereof. The frame 5 is fixed on the rear side of the reflector 3 at one end by using bolts. The arm 6 is connected to the other end of the frame 5 at one end through a pair of gussets 7 bolted to the frame 5 and the arm 6. The feed horn 4 positioned at the focal point is fixed on the other end of the arm 6.

In such a conventional parabolic antenna, the position of the feed horn 4 is adjusted to be located at the focal point of the reflector 3 by varying the fixing position of the feed horn 4 on the arm 6 and/or the angle between the frame 5 and the arm 6. This, however, is rather difficult and cumbersome since the bolts must be loosened and fastened.

SUMMARY OF THE INVENTION

It is, therefore, a primary object of the invention to provide a parabolic antenna capable of allowing the positioning of the feed horn at the focal point of the reflector with ease.

In accordance with an aspect of the present invention, there is provided a parabolic antenna comprising: a reflector; a feed horn positioned at a focal point of the reflector; a frame fixed on a rear side of the reflector at one end; an arm on one end of which the feed horn is fixed; and means for connecting the frame and the arm and adjusting an angle therebetween.

The connecting and angle adjusting means includes a pair of hinges extending from the other end of the arm and spaced apart from each other; a boss extending from the other end of the frame and interposed between the hinges; a shaft fitted through one hinge and into the boss and the other hinge; and means for holding the arm and the frame at a certain angle.

In accordance with another aspect of the present invention, there is provided a parabolic antenna comprising: a reflector; a feed horn positioned at a focal point of the reflector; a frame fixed on a rear side of the reflector at one end; a hollow arm, one end of which is connected to the other end of the frame; a moving member on top of which the feed horn is fixed, the moving member being inserted into the hollow arm; and means for holding the moving member at a desired position.

In accordance with still another aspect of the present invention, there is provided a parabolic antenna comprising: a reflector; a feed horn positioned at a focal point of the reflector; a frame fixed on a rear side of the reflector at one end; a hollow arm one end of which is connected to the other end of the frame; means for connecting the frame and the hollow arm and adjusting an angle therebetween; a moving member on top of which the feed horn is fixed, the moving member being inserted into the hollow arm; and/means for holding the moving member at a desired position.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
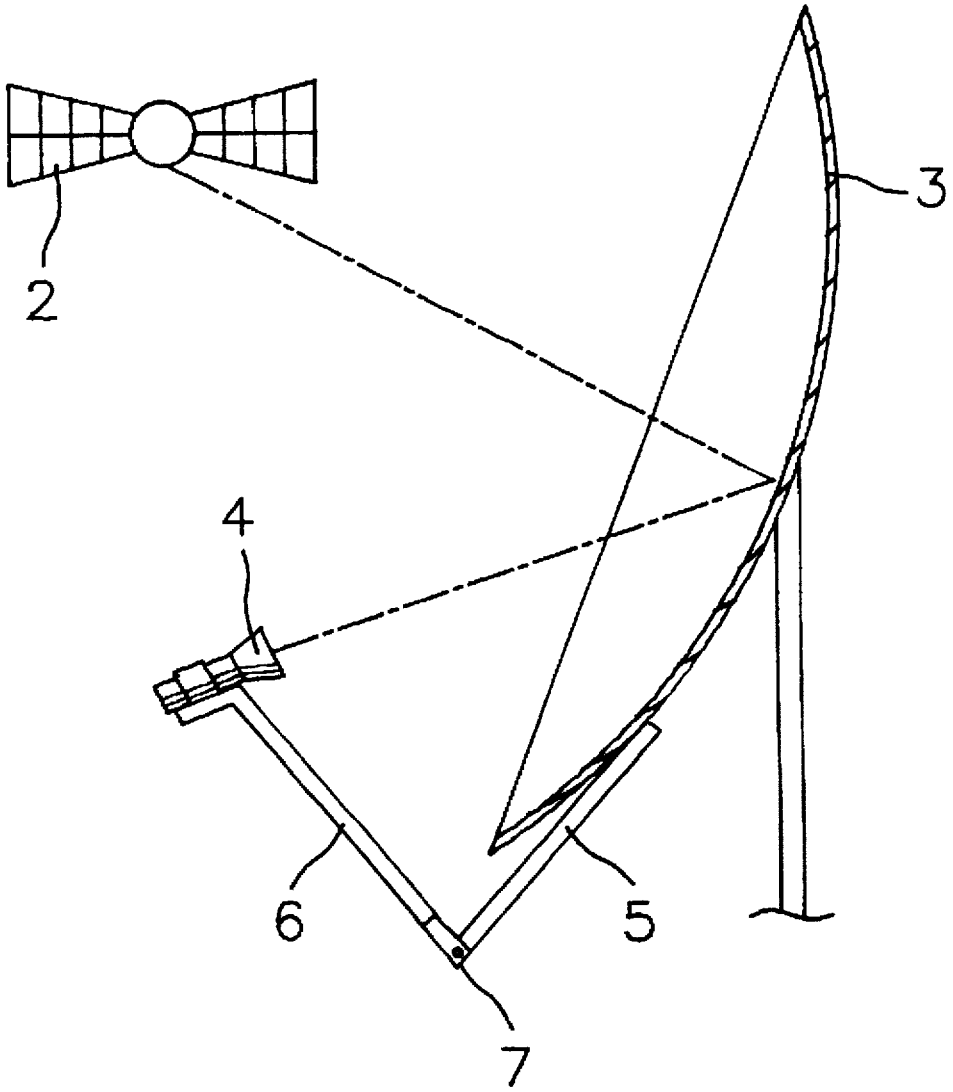
FIG. 1 (PRIOR ART)
FIG. 1 represents a schematic view of a conventional parabolic antenna.
Figure 2:
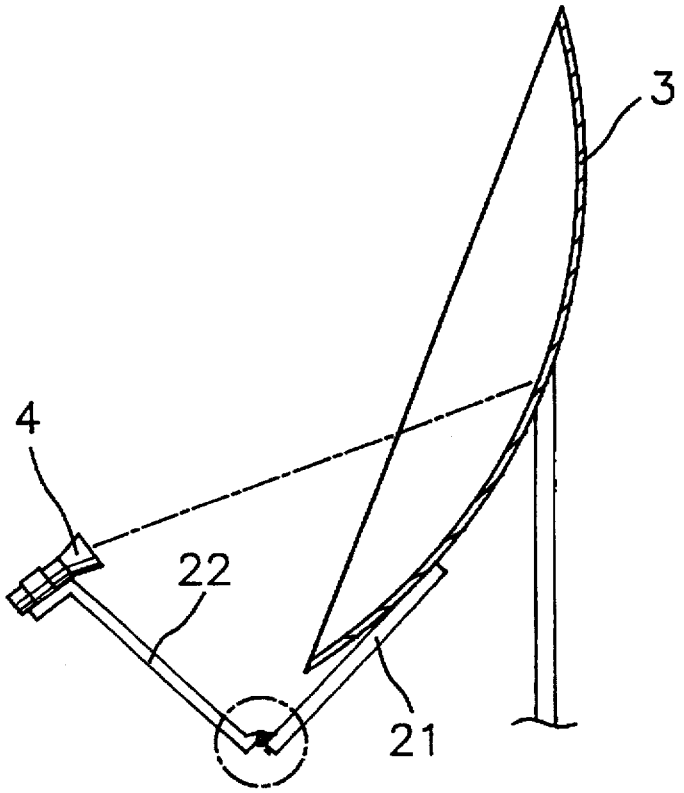
FIG. 2 depicts a schematic view of a parabolic antenna in accordance with a preferred embodiment of the present invention.
Figure 2A:
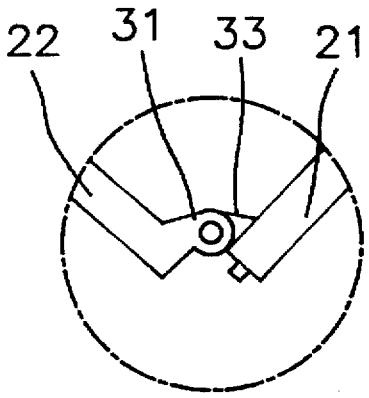
FIG. 2A is a partial enlarged view of FIG. 2

There is shown in FIG. 2 a schematic view of a parabolic antenna in accordance with a preferred embodiment of the present invention.

The inventive parabolic antenna comprises a reflector 3, a feed horn 4, a frame 21, an arm 22 and a means for connecting the frame 21 and the arm 22 and adjusting an angle therebetween.

The frame 21 is fixed on a rear side of the reflector 3 at one end by using a fastening means, e.g., bolt. The arm 22 is connected to the other end of the frame 21 at one end through the connecting and angle adjusting means. The feed horn 4 positioned at a focal point of the reflector 3 is fixed on the other end of the arm 22.

Figure 3:
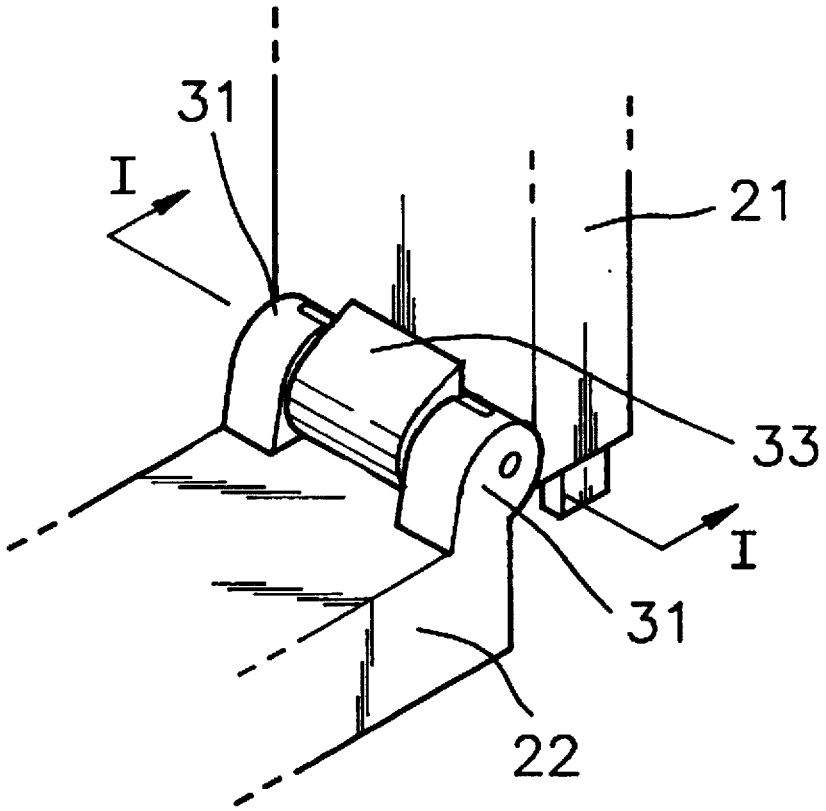
FIG. 3 sets forth an enlarged partial perspective view showing the connecting and angle adjusting means of FIG. 2.
Figure 4:
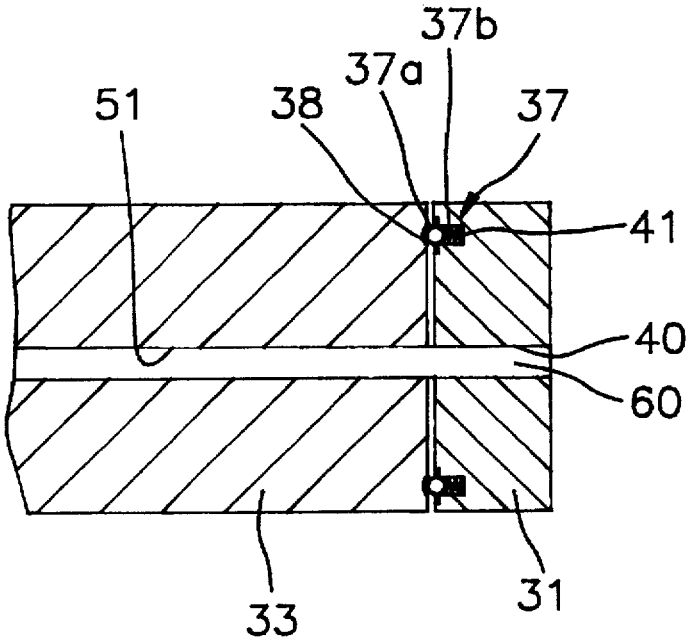
FIGS. 4 to 8 present cross-sectional views taken along I—I in FIG. 3, which show various types of the connecting and angle adjusting means, respectively.

The connecting and angle adjusting means is provided with a pair of hinges 31 extending from the end of the arm 22 connected to the frame 21 and spaced apart from each other, a boss 33 extending from the end of the frame 21 connected to the arm 22 and interposed between the hinges 31, a shaft 60 and at least one ball stopper 37, as shown in detail in FIGS. 3 and 4.

Each of the hinges 31 has a central hole 40 and at least one blind hole 41 formed on the inner surface thereof in a circumferential direction. The boss 33 has a through hole 51 and a plurality of recesses 38 formed on both side surfaces thereof in a circumferential direction. The shaft 60 is fitted through one of the central holes 40 of the hinges 31 and the through hole 51 of the boss 33 and into the other central hole 40. The ball stopper 37 is comprised of a ball 37*a* and a spring 37*b* and is inserted in the blind hole 41. The spring 37*b* presses the ball 37*a* against the boss 33 so that the ball 37*a* is selectively fitted into one of the recesses 38, thereby holding the arm 22 and the frame 21 at a desired angle.

If a force beyond a predetermined magnitude is exerted on the arm 22 in a tangential direction thereof, the ball 37*a* is depressed into the blind hole 41 and deviates from the recess 38 into which the ball 37*a* is fitted. When the arm 22 is rotated by a certain angle, the ball 37*a* comes to be fitted into next recess 38. The angle depends on the number of recesses 38.

Figure 5:
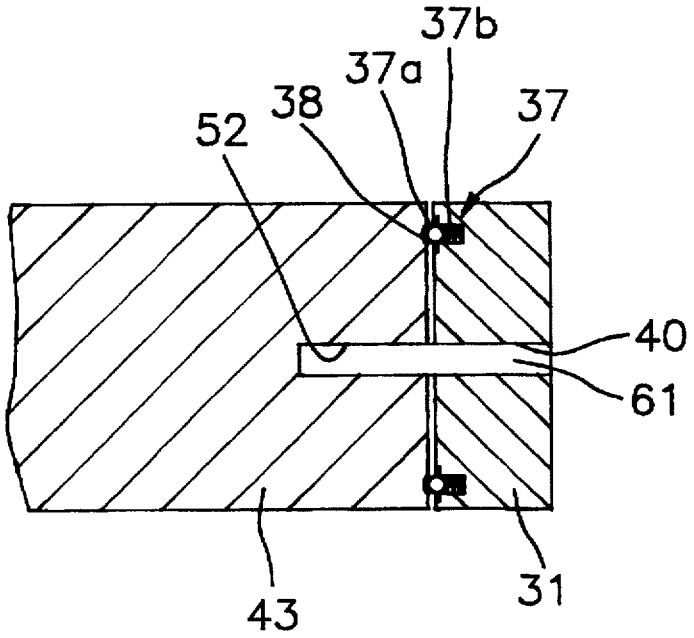
Figure 6:
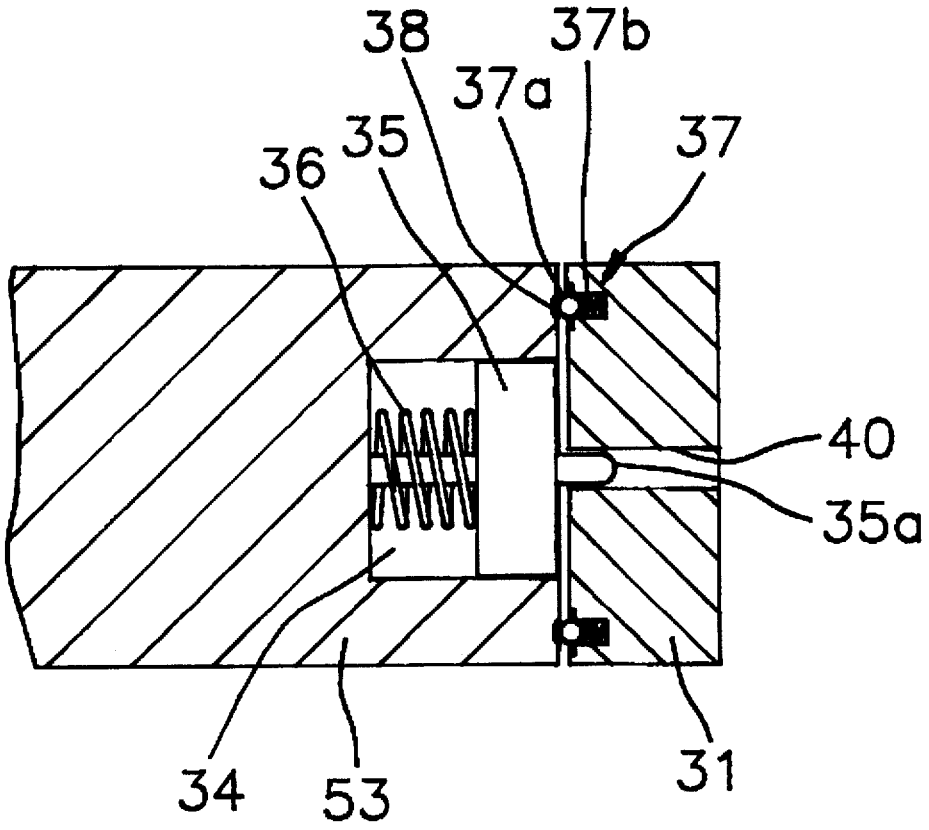

Alternatively, the connecting and angle adjusting means may have a boss 43 having a pair of blind holes 52 in lieu of the through hole 51, and a pair of shafts 61 being fitted through the central holes 40 of the hinges 31 and into the blind holes 52 of the boss 43, respectively, as shown in FIG. 5. Furthermore, an shown in FIG. 6, the connecting and angle adjusting means may have a boss 53 having a pair of cavities 34 with a desired depth on both side surfaces thereof in lieu of the through hole 51, a pair of compressive springs 36 and a pair of friction plates 35 each of which is provided with a protrusion 35*a* which is adapted to be fitted into the central hole 40 of the hinge 31. The compressive springs 36 and the friction plates 35 are inserted into the cavities 34, respectively. The compressive spring 36 presses the friction plate 35 against the hinge 31, thereby allowing the protrusion 35*a* to be fitted into the central hole 40 and allowing the friction plate 35 to be in a frictional contact with the hinge 31.

Figure 7:
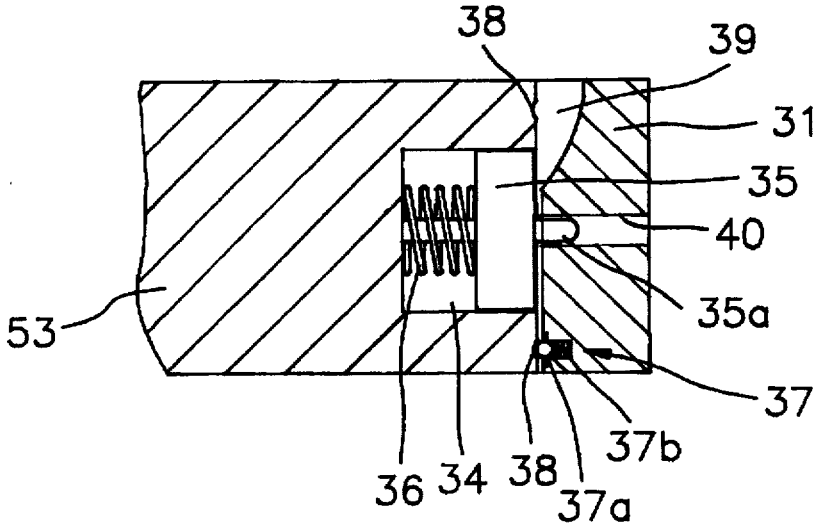

In order to facilitate the insertion of the protrusion of the friction plate 35 into the central hole 40, it is preferable that the hinges 31 be provided with a groove 39 having a varying depth which is decreased from a circumferential surface toward the hole 40 thereof, as shown in FIG. 7. The protrusion 35*a* of the friction plate 35 moves along the groove, and is then inserted into the central hole 40 by the compressive spring 36 pressing the friction plate 35.

Figure 8:
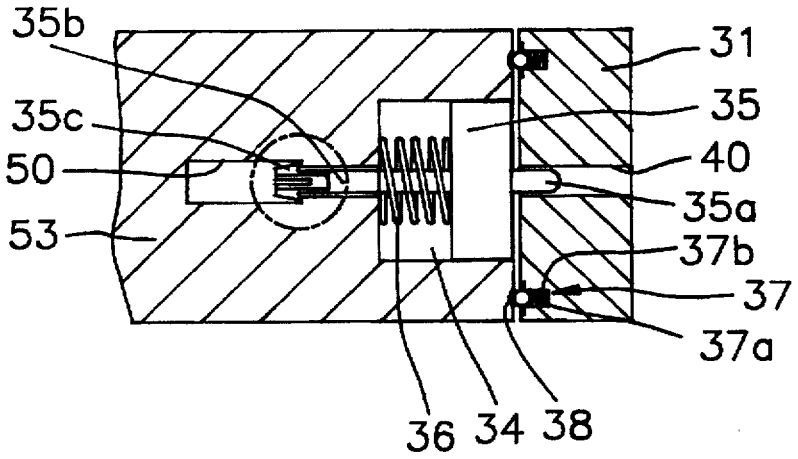
Figure 8A:
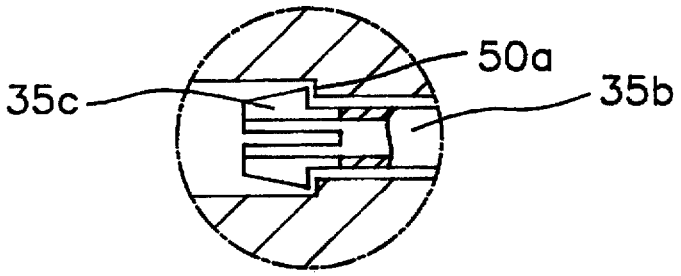
FIG. 8A is a partial enlarged view of FIG. 8.

Furthermore, as shown in FIG. 8, the boss 53 may have a pair of stepped cavities 50 for preventing the friction plates 35 from separating therefrom, the stepped cavities 50 extending toward each other from bottom surfaces of the cavities 34, respectively, and the friction plate 35 may have an extending member 35*b* with a hook 35*c*, the hook 35*c* being fitted onto a stepped portion 50*a* of the stepped cavity 50.

In the above descriptions, although the hinges and the boss respectively extend from the arm and the frame in the above, they may be reversed.

In such a parabolic antenna, the angle between the frame and the arm can be adjusted only by exerting a force beyond the predetermined magnitude on the arm without loosening and fastening of the bolts as observed in the prior art.

Figure 9:
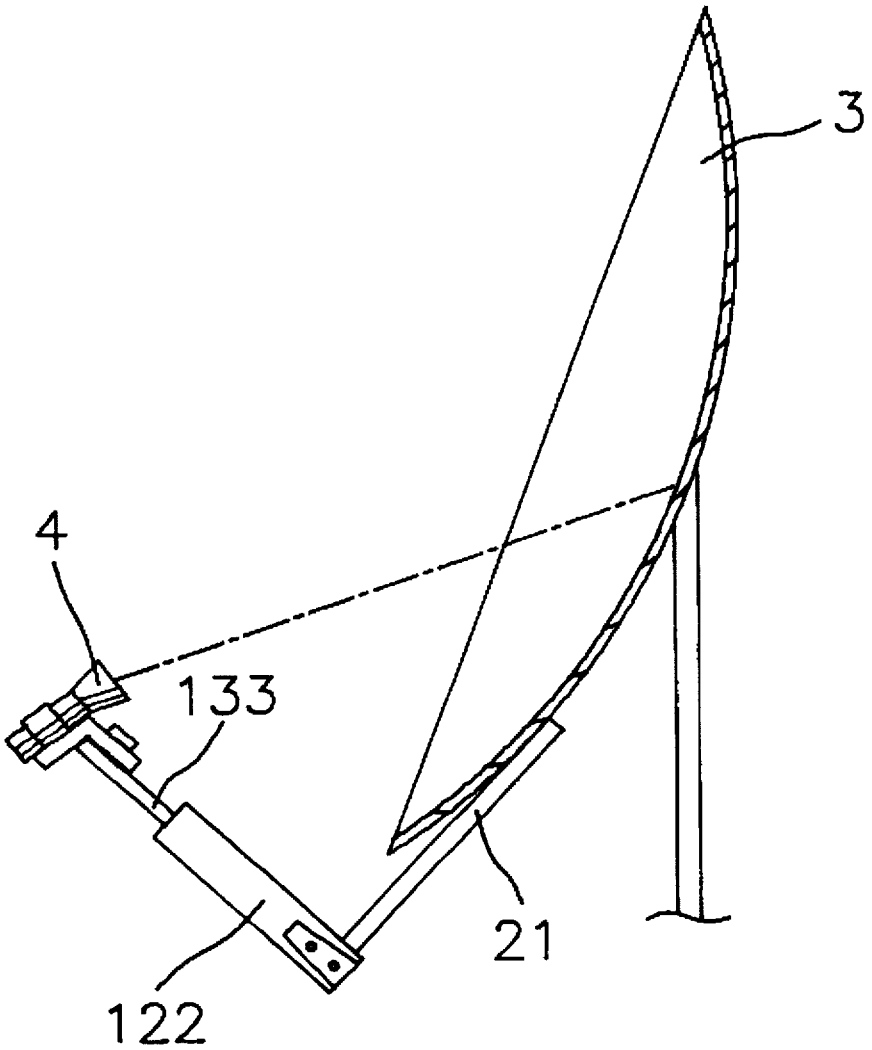
FIG. 9 illustrates a schematic view of a parabolic antenna in accordance with another preferred embodiment of the present invention.

There is shown in FIG. 9 a schematic view of a parabolic antenna in accordance with another preferred embodiment of the present invention.

The parabolic antenna of the second preferred embodiment of the present invention comprises a reflector 3, a feed horn 4, a frame 21, a hollow arm 122, a moving member 133 and a means for holding the moving member 133 at a desired position.

The frame 21 is fixed on a rear side of the reflector 3 at one end by using a fastening means, e.g., bolt. The hollow arm 122 is connected to the other end of the frame 21 at one end through an connecting means, e.g., bolt. The moving member 133 is inserted into the hollow arm 122. The feed horn 4 positioned at a focal point of the reflector 3 is fixed on top of the moving member 133.

Figure 10:
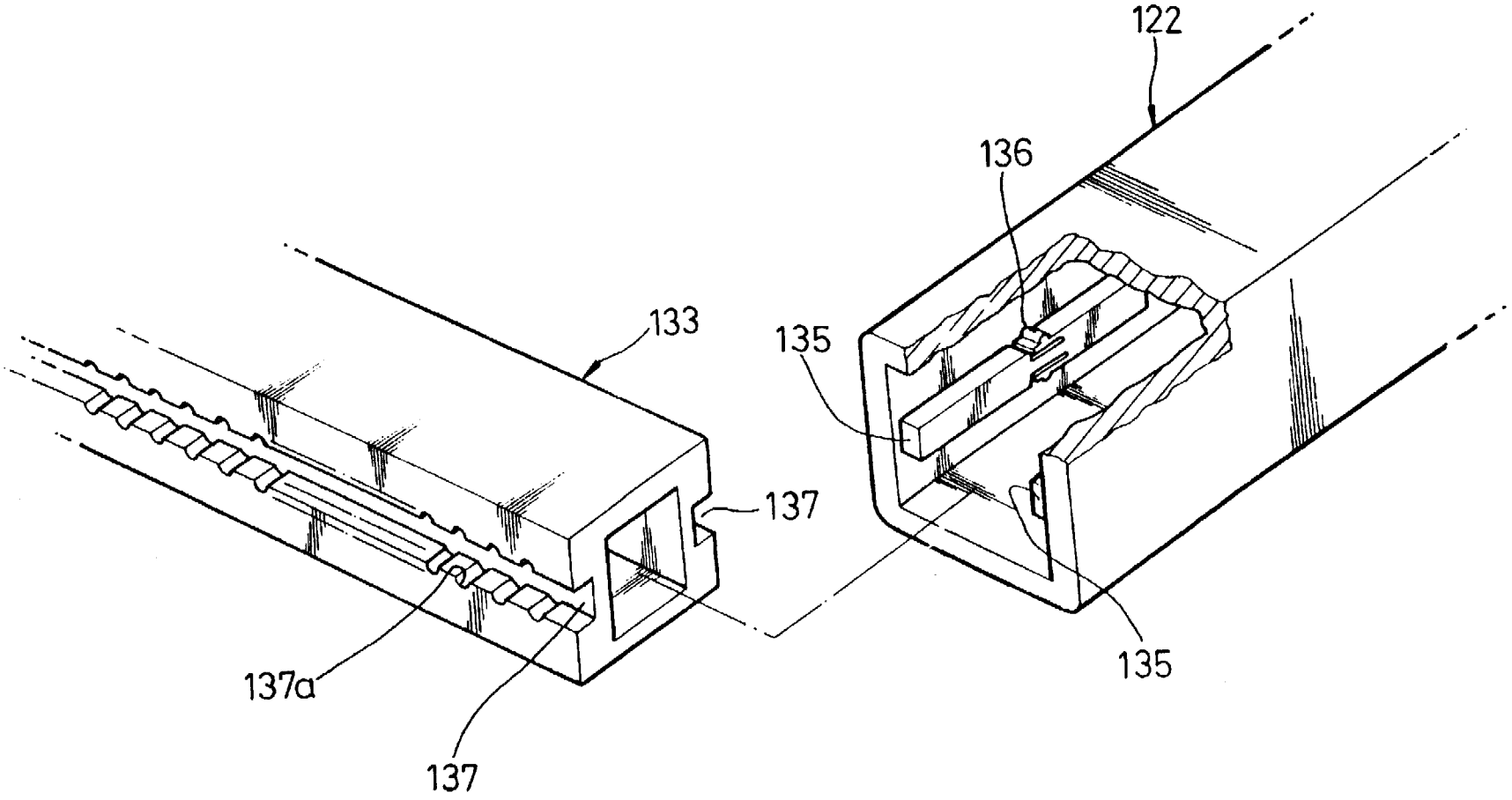
FIG. 10 sets forth an enlarged partial perspective view showing the moving member and the hollow arm of FIG. 9.
Figure 11:
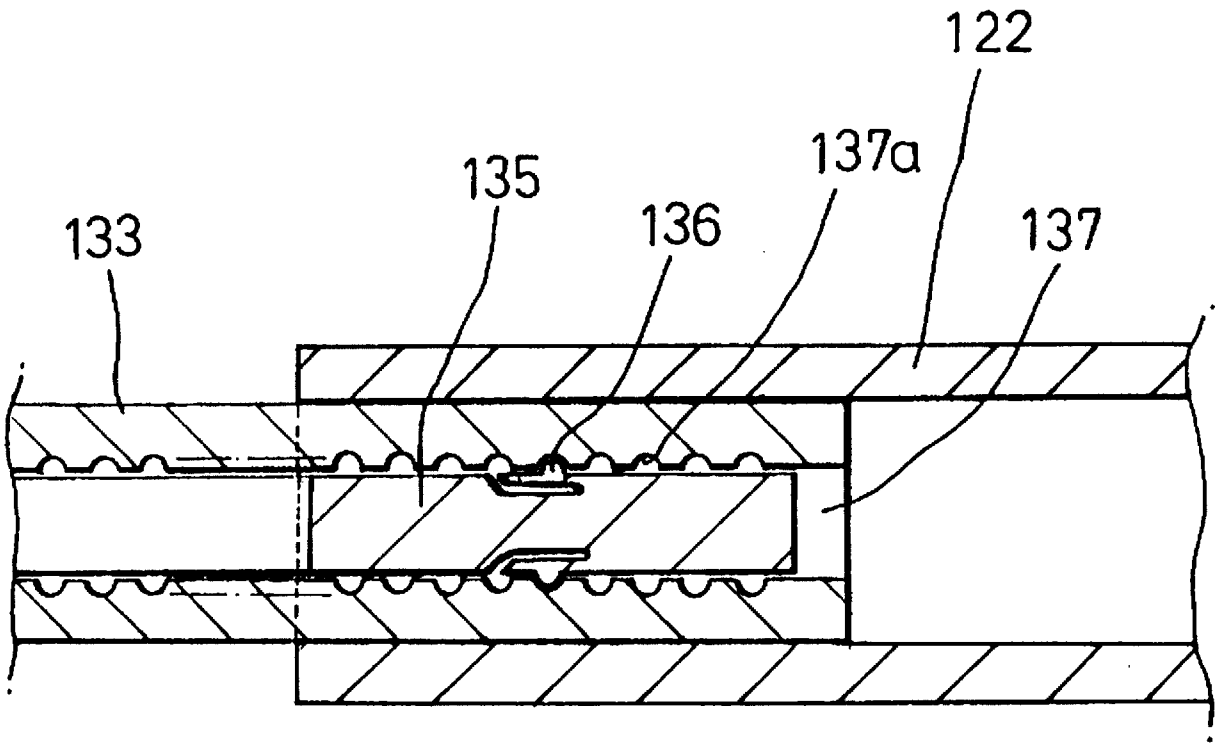
FIG. 11 represents an enlarged partial longitudinal sectional view showing the moving member and the hollow arm of FIG. 9.

As shown in detail in FIGS. 10 and 11, the moving member 133 is provided with a pair of guide grooves 137 on opposite side surfaces thereof, and the hollow arm 122 includes a pair of guide rails 135 protruding from opposite inner side surfaces thereof and extending in a longitudinal direction thereof.

The moving member holding means is provided with at least one elastic restrainer 136 provided on each guide rail 135, and a plurality of depressions 137*a* formed on an upper and a lower surfaces of the guide groove 137.

The guide groove 137 slides along the guide rail 135 and the elastic restrainer 136 is then fitted into one of the depressions 137*a*.

If a force beyond a predetermined magnitude is exerted to the moving member 133 in a longitudinal direction thereof, the elastic restrainer 136 is depressed and deviates from the depression 137*a* so that the moving member 133 moves in the hollow arm 122. Then, the elastic restrainer 136 is restored by the elastic force thereof and fitted into the next depression 137*a*. In this way, the position of the feed horn 4 can be adjusted.

In the second preferred embodiment described above, although the moving member 133 and the hollow arm 122 have a substantial rectangular cross-section profile, they may have another cross-section profile such as a substantial circular or polygonal cross-section profile. In addition, the moving member and the hollow arm may have one or more guide grooves and one or more guide rails, respectively, and the guide rails 135 and the guide grooves 137 may be provided to the moving member 133 and the hollow arm 122, respectively.

Figure 12:
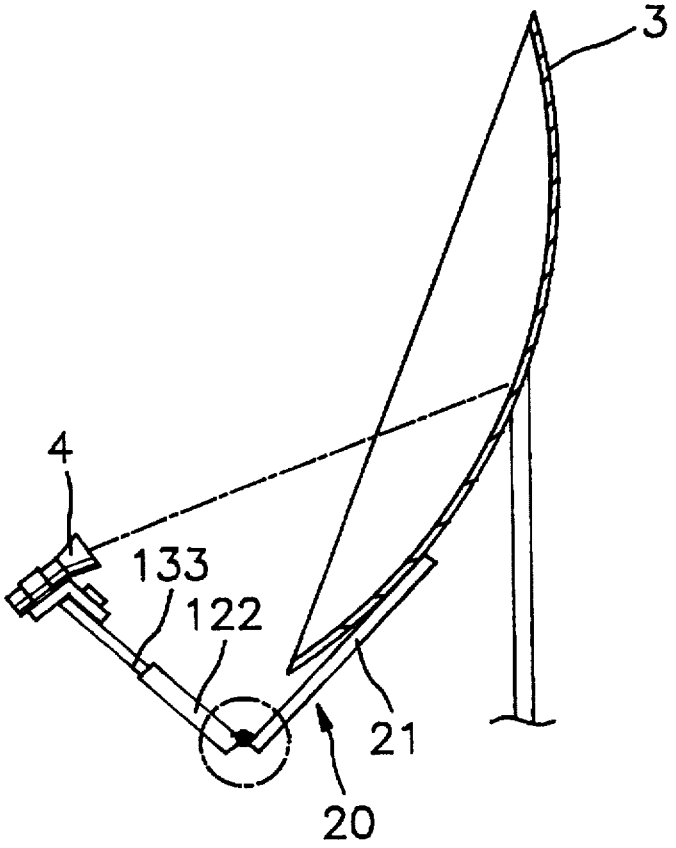
FIG. 12 depicts a schematic view of a parabolic antenna in accordance with still another preferred embodiment of the present invention.
Figure 12A:
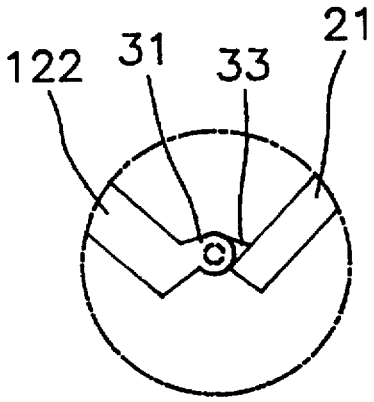
FIG. 12A is a partial enlarged view of FIG. 12.

Furthermore, as shown in FIG. 12, the hollow arm 122 may be connected to the frame 21 through any one of the connecting and angle adjusting means shown in FIGS. 3 to 8.

Although the invention has been shown and described with respect to the preferred embodiments, it will be understood by those skilled in the art that various changes and modifications may be made without departing from the spirit and scope of the invention as defined in the following claims.

What is claimed is:

1. A parabolic antenna comprising:

a reflector;

a feed horn positioned at a focal point of the reflector;

a frame fixed at a first end thereof on a rear side of the reflector;

an arm having a first end to which the feed horn is fixed; and means for connecting the frame and the arm and adjusting an angle therebetween, said means comprising:

a pair of spaced apart hinges extending from a second end of one of the arm and the frame, each of the hinges having a central hole and at least one blind hole formed on an inner surface thereof in a circumferential direction;

a boss extending from a second end of the other of the arm and the frame and interposed between the hinges, the boss having a through hole and a plurality of recesses formed on both side surfaces thereof in a circumferential direction;

a shaft fitted through the central hole of one hinge and the through hole of the boss and into the central hole of the other hinge; and means for holding the arm and the frame at a desired angle, the holding means having at least one ball stopper provided with a ball and a spring, the ball stopper being inserted in the blind hole, the spring pressing the ball against the boss, thereby allowing the ball to be fitted into one of the recesses thereof.

2. A parabolic antenna comprising:

a reflector;

a feed horn positioned at a focal point of the reflector;

a frame fixed at a first end thereof on a rear side of the reflector;

an arm having a first end to which the feed horn is fixed; and means for connecting the frame and the arm and adjusting an angle therebetween, said means comprising:

a pair of spaced apart hinges extending from a second end of one of the arm and the frame;

a boss extending from a second end of the other of the arm and the frame and interposed between the hinges;

a pair of shafts fitted through the hinges and into the boss, respectively, and means for holding the arm and the frame at a desired angle; wherein each of the hinges has a central hole and at least one blind hole formed on an inner surface thereof in a circumferential direction;

the boss has a pair of blind holes and a plurality of recesses formed on both side surfaces thereof in a circumferential direction;

the shafts are fitted through the central holes of the hinges and into the blind holes of the boss, respectively; and the holding means has at least one ball stopper provided with a ball and a spring, the ball stopper being inserted in the blind hole of each hinge, the spring pressing the ball against the boss, thereby allowing the ball to be fitted into one of the recesses.

3. A parabolic antenna comprising:

a reflector;

a feed horn positioned at a focal point of the reflector;

a frame fixed at a first end thereof on a rear side of the reflector;

an arm having a first end to which the feed horn is fixed; and means for connecting the frame and the arm and adjusting an angle therebetween, said means comprising:

a pair of spaced apart hinges extending from a second end of one of the arm and the frame, each hinge having a central hole and at least one blind hole formed on the inner surface thereof in a circumferential direction;

a boss extending from a second end of the other of the arm and the frame and interposed between the hinges, the boss having a pair of cavities and a plurality of recesses formed on both side surfaces thereof in a circumferential direction;

a pair of compressive springs and a pair of friction plates each of which is provided with a protrusion, the compressive springs and the friction plates being inserted into the cavities, respectively, wherein each compressive spring presses the corresponding friction plate against the hinge so that the protrusion is fitted into the central hole of the hinge; and means for holding the arm and the frame at a desired angle.

4. The parabolic antenna of claim 3, wherein the holding means includes at least one ball stopper having a ball and a spring, the ball stopper being inserted in the blind hole of each hinge, the spring pressing the ball against the boss, thereby the ball being fitted into one of the recesses.

5. The parabolic antenna according to claim 3, wherein each of the hinges is provided with a groove for guiding the insertion of the protrusion into the central hole.

6. The parabolic antenna of claim 5, wherein the groove has a varying depth which decreases from a circumferential surface toward the central hole of the hinge.

7. The parabolic antenna of claim 3, further comprising means for preventing the friction plates which are inserted into the cavities from separating from the boss.

8. A parabolic antenna comprising:

a reflector;

a feed horn positioned at a focal point of the reflector;

a frame fixed on a rear side of the reflector at one end;

a hollow arm one end of which is connected to the other end of the frame, said hollow arm having an inner surface;

a moving member on top of which the feed horn is fixed, the moving member being inserted into the hollow arm, said moving member having an external surface;

at least one guide rail provided on one of the inner surface and the external surface, and extending in a longitudinal direction thereof;

at least one guide groove provided on the other of the inner surface and the external surface, the guide groove being provided with a plurality of depressions and being fitted onto the guide rail; and means for holding the moving member at a desired position, said means including an elastic restrainer provided on the guide rail, the elastic restrainer being selectively fitted into one of the depressions.

9. The parabolic antenna of claim 8, further comprising means for connecting the frame and the hollow arm and adjusting an angle therebetween.

* * * * *